US007814609B1

(12) United States Patent
Shumway

(10) Patent No.: US 7,814,609 B1
(45) Date of Patent: Oct. 19, 2010

(54) SCRAPER WITH DEBRIS COLLECTING MEANS AND ASSOCIATED METHOD

(76) Inventor: Christopher Shumway, 44521 Denmore Ave., Lancaster, CA (US) 93535

( * ) Notice: Subject to any disclaimer, the term of this patent is extended or adjusted under 35 U.S.C. 154(b) by 590 days.

(21) Appl. No.: 11/894,547

(22) Filed: Aug. 21, 2007

Related U.S. Application Data

(60) Provisional application No. 60/822,982, filed on Aug. 21, 2006.

(51) Int. Cl.
*A47L 13/02* (2006.01)

(52) U.S. Cl. ..... 15/236.01; 15/104.8; 15/248.1; 15/248.2; 30/124; 30/169

(58) Field of Classification Search ..... 15/104.8, 15/236.01, 248.1, 248.2; 30/124, 169
See application file for complete search history.

(56) References Cited

U.S. PATENT DOCUMENTS 343,389 A * 6/1886 O'Neill ..... 30/136
2,291,015 A * 7/1942 Anderson ..... 30/171
5,951,781 A * 9/1999 Lucas ..... 134/6
6,101,663 A 8/2000 Greer, Jr. et al.
6,212,778 B1 * 4/2001 Carter ..... 30/136.5
6,467,124 B1 * 10/2002 Small ..... 15/401
6,601,266 B1 8/2003 Faraci et al.

* cited by examiner

*Primary Examiner*—Monica S Carter
*Assistant Examiner*—Stephanie Newton

(57) ABSTRACT

A scraping apparatus includes an elongated tubular shaft with open proximal and distal ends in fluid communication with each other along an entire longitudinal length of the tubular shaft. The apparatus further includes a funnel, a scraping implement positioned above the funnel, a mechanism for securely maintaining the scraping implement at an elevated position above the top opening of the funnel, and a top protrusion monolithically formed with the apex and situated substantially parallel to the top opening of the funnel and juxtaposed proximal thereto. Such a top protrusion has a planar top surface.

15 Claims, 3 Drawing Sheets

SCRAPER WITH DEBRIS COLLECTING MEANS AND ASSOCIATED METHOD

CROSS REFERENCE TO RELATED APPLICATIONS

This application claims the benefit of U.S. Provisional Application No. 60/822,982, filed Aug. 21, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to ceiling scrapers and, more particularly, to a ceiling scraper with debris collecting means for removing and collecting drywall spackling from a ceiling.

2. Prior Art

Americans have a love-hate relationship with popcorn ceilings. Back in the 1970s, popcorn ceilings, sprayed-on surfaces that looked like cottage cheese, were everywhere. But tastes change, and yesterday's popcorn ceiling may not be the look you want today. Contractors like them because they're easy to install with a sprayer and they hide imperfections. But many homeowners loathe the cottage cheese look and many bite the aesthetic bullet and hire a contractor to remove the popcorn design from their ceilings.

To save the expense, some homeowners ultimately decide to scrape the popcorn design off them self. Homeowners who are determined to tackle the project themselves should prepare for a lot of work, because, if you want the popcorn design to come down properly, you're in for a tedious, messy job. Removing popcorn ceilings requires a lot of prep work and time. Before scraping the popcorn design, one must have the ceiling tested for asbestos. A professional asbestos testing firm can provide instructions on how to create a ceiling sample. Results typically come back in a few days. The mineral fibers increase the risk of cancer and lung disease if they are released in the air, according to the Environmental Protection Agency. Undisturbed, asbestos is harmless. If a ceiling contains less than 1 percent asbestos, it is safe for homeowners to scrape.

The do-it-yourself enthusiast must begin the task by covering their floors and furniture with protective drop cloths, which also help contain the debris. Next, they spray sections of the ceiling with water so the popcorn comes off easily with a stiff putty knife. Smart scrapers hold a bucket underneath the scraper so that not all the debris falls on the floor. Even if a bucket is used, a lot of dust and debris is created which falls outside of the bucket and must be cleaned up later. This, of course, adds to the amount of time and effort taken to accomplish the job. Obviously, it would be advantageous to provide a means for collecting dust and debris that is created during overhead scraping procedures.

U.S. Pat. No. 6,601,266 to Faraci discloses a vacuum device for scraping and cleaning a ceiling that includes a ceiling scraper and a vacuum accessory. The ceiling scraper has a handle extending rearwardly from a blade with the blade having a scraping edge adapted to scrape materials from a ceiling at the forward edge thereof. The vacuum accessory has a rearward facing vacuum tube which is adapted to engage a vacuum hose from a vacuum device. Further, the vacuum accessory has a covered tray extending forwardly from the vacuum tube with the covered tray having a vacuum slot opposite the vacuum tube. The vacuum slot, the interior of the covered tray and the vacuum tube are all in gaseous communication. Lastly, the vacuum accessory is adapted to releasably hold the ceiling scraper whereby the scraping edge is positioned directly over the vacuum slot. Unfortunately, this prior art example does not prevent the need for a user to climb a ladder to effectively scrape the ceiling.

U.S. Pat. No. 6,101,663 to Greer discloses a scraper system for removing acoustic texture materials comprised of an integral debris collection assembly. The system is comprised a scraper assembly comprised of a scraper blade maintained at an angle with respect to a handle portion. A band is provided that defines at least a portion of a rectangular perimeter that, in use, is arranged below the scraper blade. A bag is attached to the band so that acoustic texture material removed by the scraper blade falls into the bag. The band is made of resilient material and is attached to the scraper assembly in a manner that allows the band to deflect when it contacts a wall surface adjacent to the ceiling surface. This allows the scraper blade to reach along the wall surface. But the band returns to its original position with the perimeter defined thereby under the blade when the blade is not scraping near the wall surface. Unfortunately, this prior art example does not provide a vacuum for easy cleanup procedures.

U.S. Pat. No. 6,467,124 to Small discloses a new and improved ceiling surface and texture removal tool. More particularly, the present invention relates to a device which enables a renovation professional to apply an even, continuous application of liquid to a ceiling texture or surface to facilitate rapid safe removal of said ceiling surface texture materials. The operator is provided with an adjustable scraping tool, having a replaceable scraping blade, and with handle extension attachments for conveniently reaching overhead surfaces. The resultant debris from the removal of ceiling surface or texture is immediately carried away by use of an integrally attached vacuum system, and delivered to a collection hopper for containment and subsequent disposal. The present device provides for a time saving, labor saving, ergonomic and efficient means by which to remove ceiling surfaces and textures while preventing formation of aerosols or dust particles which might otherwise be inhaled and represent a potential health hazard to the user. Unfortunately, this prior art example does not provide a method for attaching the apparatus to a preexisting vacuum.

Accordingly, the present invention is disclosed in order to overcome the above noted shortcomings. The present invention satisfies such a need by providing an apparatus that is convenient and easy to use, lightweight yet durable in design, and designed for removing spackling from a ceiling. The present invention is simple to use, inexpensive, and designed for many years of repeated use.

BRIEF SUMMARY OF THE INVENTION

In view of the foregoing background, it is therefore an object of the present invention to provide an apparatus for removing drywall spackling from a ceiling. These and other objects, features, and advantages of the invention are provided by a scraping apparatus.

A scraping apparatus includes an elongated tubular shaft with open proximal and distal ends in fluid communication with each other along an entire longitudinal length of the tubular shaft. Such a distal end of the tube has an arcuate shape extending upwardly and away from the proximal end.

The apparatus further includes a funnel monolithically formed with the distal end. Such a funnel is angularly offset from a horizontal plane in such a manner that the funnel effectively extends upwardly along a predetermined angle away from the tubular shaft.

The apparatus further includes a scraping implement positioned above the funnel and situated adjacent to a proximal side thereof such that the scraping implement conveniently extends away from the proximal end of the shaft and terminates above a top opening of the funnel.

The apparatus further includes a mechanism for securely maintaining the scraping implement at an elevated position above the top opening of the funnel and spaced from the tubular shaft. Such a maintaining mechanism advantageously includes a bracket including monolithically connected first and second arms forming an apex disposed adjacent to the top opening of the funnel and situated above the distal end of the tubular shaft. Each of such first and second arms has a coupling monolithically formed at bottom ends thereof, and such couplings are concentrically and statically connected directly to the tubular shaft. The maintaining mechanism further includes a top protrusion monolithically formed with the apex and situated substantially parallel to the top opening of the funnel and juxtaposed proximal thereto. Such a top protrusion has a planar top surface.

The scraping implement is statically affixed directly to the planar top surface of the bracket and is downwardly offset from a horizontal plane and angled outwardly away from the top opening of the funnel. A distal end of the scraping implement has a beveled tip angled upwardly and away from a circumference of the funnel. The scraping implement further has a diameter that is effectively smaller than a diameter of the funnel so that drywall spackling particulates fall into the funnel after being scraped from the ceiling. The bracket is vertically aligned above the tubular shaft.

A method for removing and collecting drywall spackling from a ceiling includes the steps of providing an elongated tubular shaft with open proximal and distal ends in fluid communication with each other along an entire longitudinal length of the tubular shaft. Such a distal end of the tube has an arcuate shape extending upwardly and away from the proximal end. The steps further include providing a funnel monolithically formed with the distal end. Such a funnel is angularly offset from a horizontal plane in such a manner that the funnel extends upwardly along a predetermined angle away from the tubular shaft.

The steps further include: positioning a scraping implement above the funnel by situating the scraping implement adjacent to a proximal side thereof such that the scraping implement extends away from the proximal end of the shaft and terminates above a top opening of the funnel; and securely maintaining the scraping implement at an elevated position above the top opening of the funnel and spaced from the tubular shaft while scraping the drywall spackling.

The method further includes these steps of: providing a bracket including monolithically connected first and second arms forming an apex disposed adjacent to the top opening of the funnel and situated above the distal end of the tubular shaft, each of the first and second arms having a coupling monolithically formed at bottom ends thereof; concentrically and statically connecting the couplings directly to the tubular shaft; and situating a top protrusion of the bracket substantially parallel to the top opening of the funnel. Such a top protrusion has a planar top surface.

The method further includes the steps of: statically affixing the scraping implement directly to the planar top surface of the bracket; and downwardly offsetting the scraping implement from a horizontal plane by angling the scraping implement outwardly away from the top opening of the funnel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
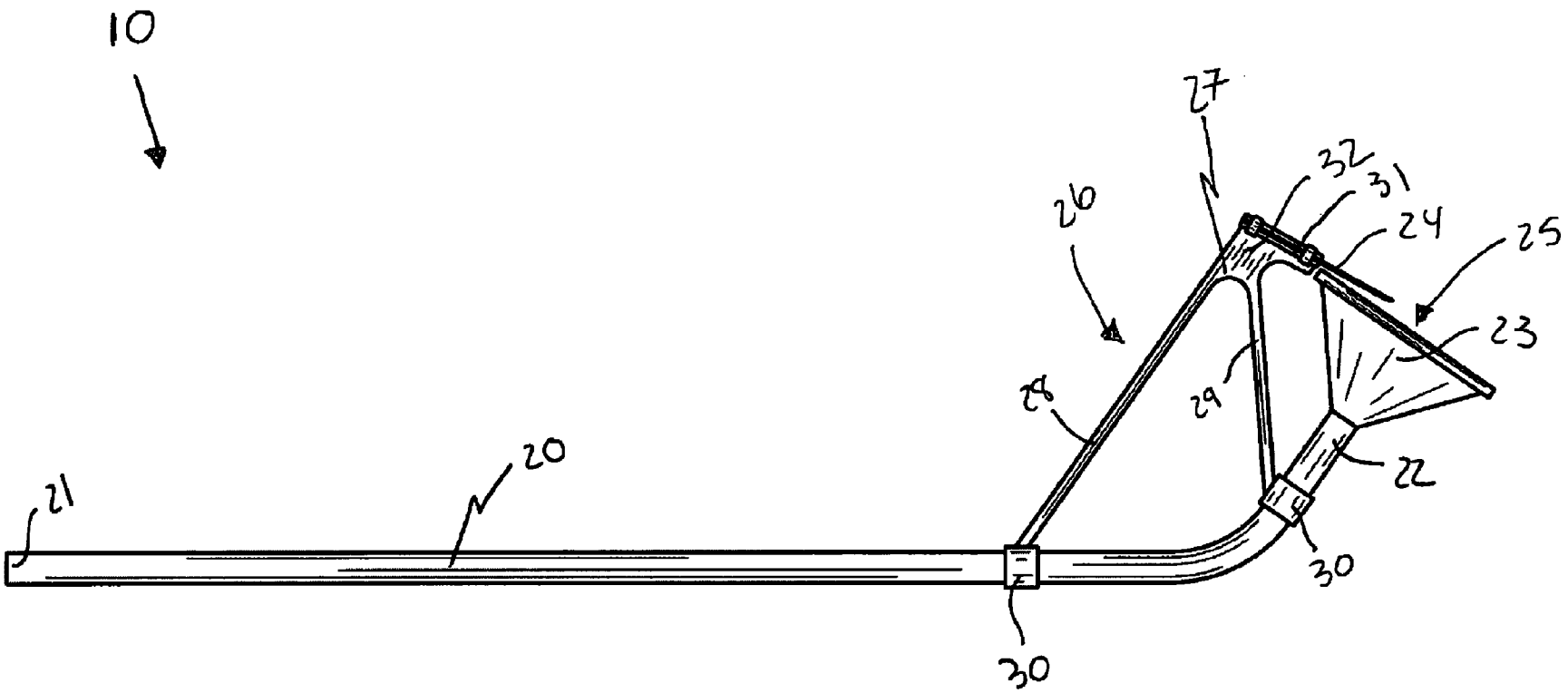
FIG. 1 is a side elevational view of the scraping apparatus, in accordance with the present invention.
Figure 2:
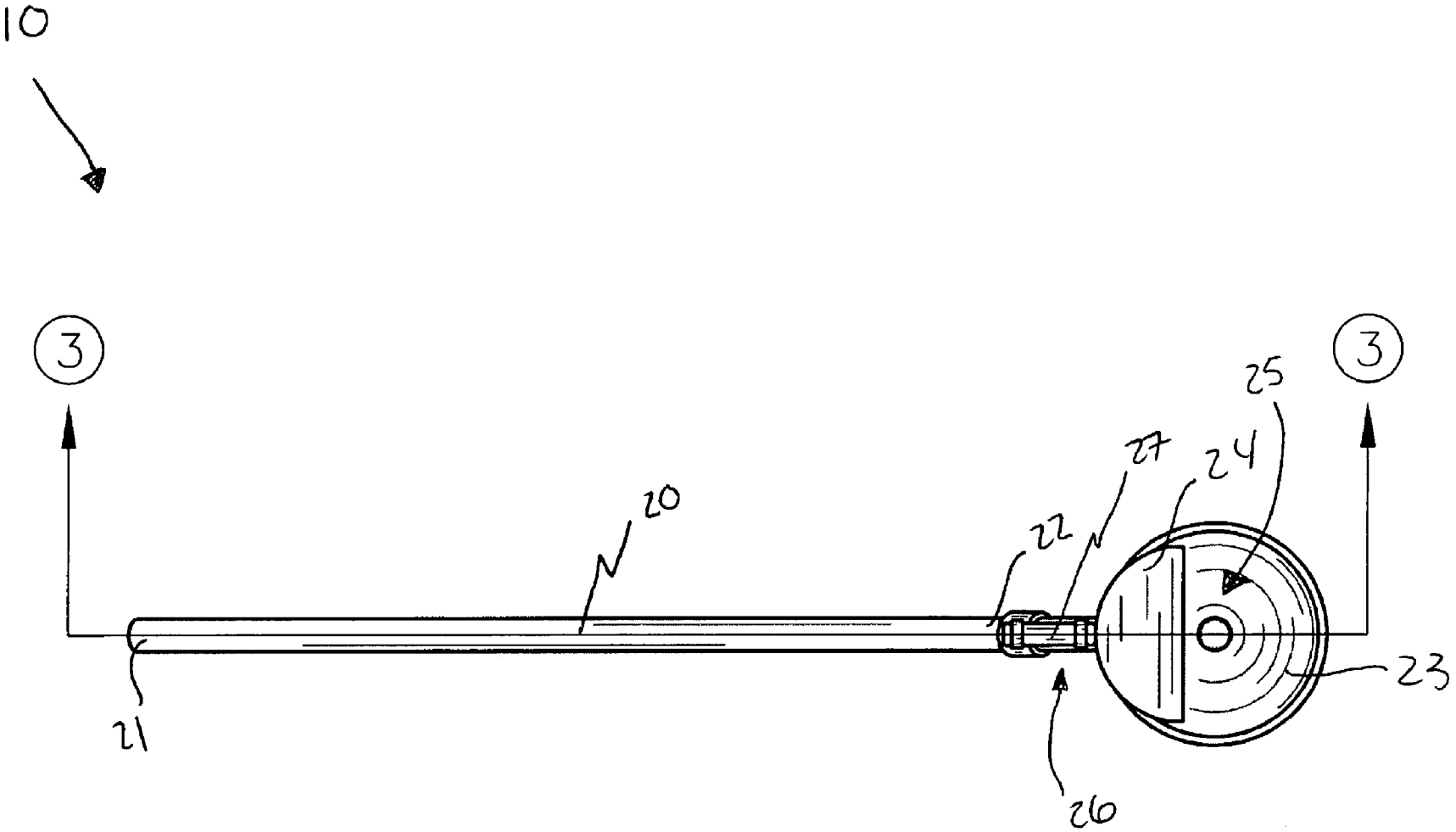
FIG. 2 is a cross sectional view of the scraping apparatus, in accordance with the present invention.
Figure 3:
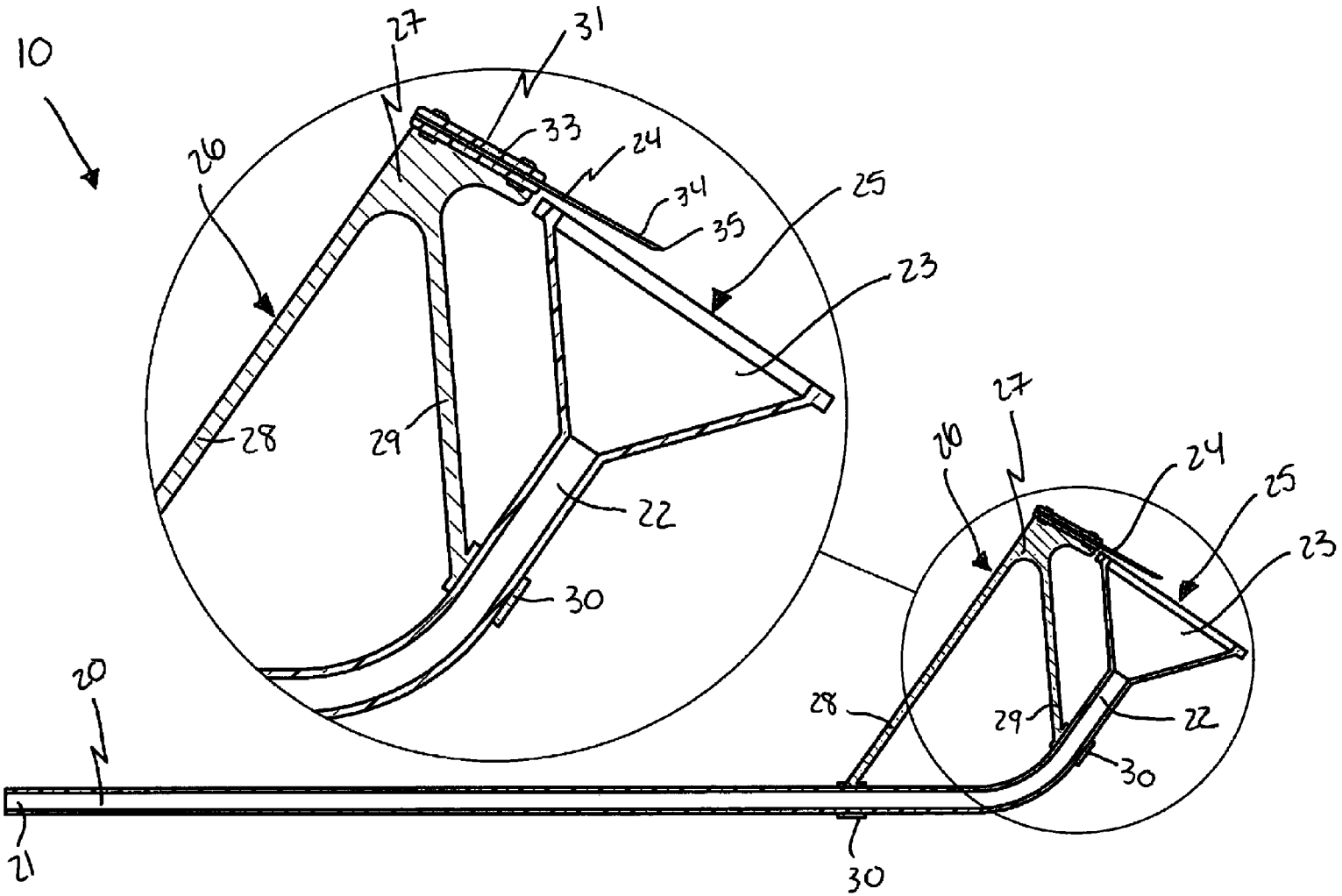
FIG. 3 is a top planar view of the scraping apparatus, in accordance with the present invention.

The apparatus of this invention is referred to generally in FIGS. 1-3 by the reference numeral 10 and is intended to protect a scraping apparatus. It should be understood that the apparatus 10 may be used to collect many different types of debris and should not be limited in collecting only those types of debris mentioned herein.

Referring to FIGS. 1, 2 and 3, a scraping apparatus 10 includes an elongated tubular shaft 20 with open proximal and distal ends 21, 22 in fluid communication with each other along an entire longitudinal length of the tubular shaft 20. Such a distal end 22 of the tube 20 has an arcuate shape extending upwardly and away from the proximal end 21. The elongated tubular shaft 20 allows a user to reach high surfaces without the use of a ladder.

Referring again to FIGS. 1, 2 and 3, the apparatus further includes a funnel 23 monolithically formed with the distal end 22. Such a funnel 23 is angularly offset from a horizontal plane in such a manner that the funnel 23 extends upwardly along a predetermined angle away from the tubular shaft 20. The funnel 23 is provided for collecting debris as it is scraped from the ceiling.

Referring again to FIGS. 1, 2 and 3, the apparatus further includes a scraping implement 24 positioned above the funnel 23 and situated adjacent to a proximal side thereof which is essential such that the scraping implement 24 extends away from the proximal end 21 of the shaft 20 and terminates above a top opening 25 of the funnel 23. The scraping implement 24 is used for easily removing unwanted debris from the ceiling.

Referring again to FIGS. 1, 2 and 3, the apparatus further includes a mechanism for securely maintaining the scraping implement 24 at an elevated position above the top opening 25 of the funnel 23 and spaced from the tubular shaft 20. Such a maintaining mechanism 26 includes a bracket 27 including monolithically connected first and second arms 28, 29 forming an apex 32 disposed adjacent to the top opening 25 of the funnel 23 and situated above the distal end 22 of the tubular shaft 20. Each of such first and second arms 28, 29 has a coupling 30 monolithically formed at bottom ends thereof, and such couplings 30 are concentrically and statically connected directly, without the use of intervening elements, to the tubular shaft 20. The maintaining mechanism 26 further includes a top protrusion 31 monolithically formed with the apex 32 and situated substantially parallel to the top opening 25 of the funnel 23 and juxtaposed proximal thereto. Such a top protrusion 31 has a planar top surface 33. The maintaining mechanism ensures that the scraping mechanism remains properly affixed above the funnel, for properly collecting debris.

The scraping implement 24 is statically affixed directly, without the use of intervening elements, to the planar top surface 33 of the bracket 27 and is downwardly offset from a horizontal plane and angled outwardly away from the top opening 25 of the funnel 23. A distal end 34 of the scraping implement 34 has a beveled tip 35 angled upwardly and away from a circumference of the funnel 23. The scraping implement 24 further has a diameter that is smaller than a diameter of the funnel 23 which is critical so that drywall spackling particulates fall into the funnel 23 after being scraped from the ceiling. The bracket 27 is vertically aligned above the tubular shaft 20.

The present invention, as claimed, provides the unexpected and unpredictable benefit of providing an elongated tube 20 for attachment to a preexisting vacuum. In addition, the funnel 23 ensures that the debris is directed into the tube 20 rather scattering on the floor or on a user. Such benefits overcome the prior art shortcomings.

In use, a method for removing and collecting drywall spackling from a ceiling includes the steps of providing an elongated tubular shaft 20 with open proximal and distal ends 21, 22 in fluid communication with each other along an entire longitudinal length of the tubular shaft 20. Such a distal end 22 of the tube 20 has an arcuate shape extending upwardly and away from the proximal end 21. The steps further include providing a funnel 23 monolithically formed with the distal end 22. Such a funnel 23 is angularly offset from a horizontal plane in such a manner that the funnel 23 extends upwardly along a predetermined angle away from the tubular shaft 20.

In use, the steps further include: positioning a scraping implement 24 above the funnel 23 by situating the scraping implement 24 adjacent to a proximal side thereof such that the scraping implement 24 extends away from the proximal end 21 of the shaft 20 and terminates above a top opening 25 of the funnel 23; and securely maintaining the scraping implement 24 at an elevated position above the top opening 25 of the funnel 23 and spaced from the tubular shaft 20 while scraping the drywall spackling.

In use, the method further includes these steps of: providing a bracket 27 including monolithically connected first and second arms 28, 29 forming an apex 32 disposed adjacent to the top opening 25 of the funnel 23 and situated above the distal end 22 of the tubular shaft 20, each of the first and second arms 28, 29 having a coupling 30 monolithically formed at bottom ends thereof; concentrically and statically connecting the couplings 30 directly, without the use of intervening elements, to the tubular shaft 20; and situating a top protrusion 31 of the bracket 27 substantially parallel to the top opening 25 of the funnel 23. Such a top protrusion 31 has a planar top surface 33.

In use, the method further includes the steps of: statically affixing the scraping implement 24 directly, without the use of intervening elements, to the planar top surface 33 of the bracket 27; and downwardly offsetting the scraping implement 24 from a horizontal plane by angling the scraping implement outwardly away from the top opening of the funnel 23.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A scraping apparatus for removing drywall spackling from a ceiling, said scraping apparatus comprising:

an elongated tubular shaft having open proximal and distal ends in fluid communication with each other along an entire longitudinal length of said tubular shaft;

a funnel monolithically formed with said distal end, said funnel being angularly offset from a horizontal plane in such a manner that said funnel extending upwardly along a predetermined angle away from said tubular shaft;

a scraping implement positioned above said funnel and situated adjacent to a proximal side thereof such that said scraping implement extends away from said proximal end of said shaft and terminates above a top opening of said funnel; and means for securely maintaining said scraping implement at an elevated position above said top opening of said funnel and spaced from said tubular shaft;

wherein said maintaining means comprises: a bracket including monolithically connected first and second arms forming an apex disposed adjacent to said top opening of said funnel and situated above said distal end of said tubular shaft, each of said first and second arms having a coupling monolithically formed at bottom ends thereof, said couplings being concentrically and statically connected directly to said tubular shaft; and a top protrusion monolithically formed with said apex and situated substantially parallel to said top opening of said funnel and juxtaposed proximal thereto, said top protrusion having a planar top surface.

2. The scraping apparatus of claim 1, wherein said scraping implement is statically affixed directly to said planar top surface of said bracket, said scraping implement being downwardly offset from a horizontal plane and angled outwardly away from said top opening of said funnel.

3. The scraping apparatus of claim 1, wherein a distal end of said scraping implement has a beveled tip angled upwardly and away from a circumference of said funnel.

4. The scraping apparatus of claim 1, wherein said scraping implement has a diameter that is smaller than a diameter of said funnel so that drywall spackling particulates fall into said funnel after being scraped from the ceiling.

5. The scraping apparatus of claim 1, wherein said bracket is vertically aligned above said tubular shaft.

6. A scraping apparatus for removing drywall spackling from a ceiling, said scraping apparatus comprising:

an elongated tubular shaft having open proximal and distal ends in fluid communication with each other along an entire longitudinal length of said tubular shaft, said distal end of said tube having an arcuate shape extending upwardly and away from said proximal end;

a funnel monolithically formed with said distal end, said funnel being angularly offset from a horizontal plane in such a manner that said funnel extending upwardly along a predetermined angle away from said tubular shaft;

a scraping implement positioned above said funnel and situated adjacent to a proximal side thereof such that said scraping implement extends away from said proximal end of said shaft and terminates above a top opening of said funnel; and means for securely maintaining said scraping implement at an elevated position above said top opening of said funnel and spaced from said tubular shaft;

wherein said maintaining means comprises: a bracket including monolithically connected first and second arms forming an apex disposed adjacent to said top opening of said funnel and situated above said distal end of said tubular shaft, each of said first and second arms having a coupling monolithically formed at bottom ends thereof, said couplings being concentrically and statically connected directly to said tubular shaft; and a top protrusion monolithically formed with said apex and situated substantially parallel to said top opening of said funnel and juxtaposed proximal thereto, said top protrusion having a planar top surface.

7. The scraping apparatus of claim 6, wherein said scraping implement is statically affixed directly to said planar top surface of said bracket, said scraping implement being downwardly offset from a horizontal plane and angled outwardly away from said top opening of said funnel.

8. The scraping apparatus of claim 6, wherein a distal end of said scraping implement has a beveled tip angled upwardly and away from a circumference of said funnel.

9. The scraping apparatus of claim 6, wherein said scraping implement has a diameter that is smaller than a diameter of said funnel so that drywall spackling particulates fall into said funnel after being scraped from the ceiling.

10. The scraping apparatus of claim 6, wherein said bracket is vertically aligned above said tubular shaft.

11. A method for removing and collecting drywall spackling from a ceiling, said method comprising the steps of:

a. providing an elongated tubular shaft having open proximal and distal ends in fluid communication with each other along an entire longitudinal length of said tubular shaft, said distal end of said tube having an arcuate shape extending upwardly and away from said proximal end;

b. providing a funnel monolithically formed with said distal end, said funnel being angularly offset from a horizontal plane in such a manner that said funnel extending upwardly along a predetermined angle away from said tubular shaft;

c. positioning a scraping implement above said funnel by situating said scraping implement adjacent to a proximal side thereof such that said scraping implement extends away from said proximal end of said shaft and terminates above a top opening of said funnel; and d. securely maintaining said scraping implement at an elevated position above said top opening of said funnel and spaced from said tubular shaft while scraping the drywall spackling;

wherein step d. comprises the steps of:

i. providing a bracket including monolithically connected first and second arms forming an apex disposed adjacent to said top opening of said funnel and situated above said distal end of said tubular shaft, each of said first and second arms having a coupling monolithically formed at bottom ends thereof;

ii. concentrically and statically connecting said couplings directly to said tubular shaft; and iii. situating a top protrusion of said bracket substantially parallel to said top opening of said funnel, said top protrusion having a planar top surface.

12. The method of claim 11, wherein step c. comprises the steps of:

i. statically affixing said scraping implement directly to said planar top surface of said bracket; and ii. downwardly offsetting said scraping implement from a horizontal plane by angling said scraping implement outwardly away from said top opening of said funnel.

13. The method of claim 11, wherein a distal end of said scraping implement has a beveled tip angled upwardly and away from a circumference of said funnel.

14. The method of claim 11, wherein said scraping implement has a diameter that is smaller than a diameter of said funnel so that drywall spackling particulates fall into said funnel after being scraped from the ceiling.

15. The method of claim 11, wherein said bracket is vertically aligned above said tubular shaft.

* * * * *